US008023686B2

(12) United States Patent
Huang et al.

(10) Patent No.: US 8,023,686 B2
(45) Date of Patent: Sep. 20, 2011

(54) LOUDSPEAKER

(75) Inventors: Kun-li Huang, Tu-Cheng (TW); Hung-chi Wang, Tu-Cheng (TW); Jiin-tarng Huang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 1146 days.

(21) Appl. No.: 11/806,278

(22) Filed: May 31, 2007

(65) Prior Publication Data

US 2008/0298629 A1 Dec. 4, 2008

(51) Int. Cl.
*H04R 1/00* (2006.01)
*H04R 9/06* (2006.01)
*H04R 11/02* (2006.01)

(52) U.S. Cl. ..... 381/396; 381/400; 381/409

(58) Field of Classification Search ..... 381/396, 381/398, 400, 403, 404, 409, 412, 423, 429, 381/433, 386

See application file for complete search history.

(56) References Cited

U.S. PATENT DOCUMENTS 4,312,118 A * 1/1982 Saik et al. ..... 29/594
2005/0232456 A1* 10/2005 Guenther ..... 381/386
2006/0171555 A1* 8/2006 Brandt ..... 381/396

* cited by examiner

*Primary Examiner* — Tuan Nguyen
(74) *Attorney, Agent, or Firm* — Rosenberg, Klein & Lee

(57) ABSTRACT

A loudspeaker includes a basket defining a center hole therethrough, a conduction wire board fixed to the bottom surface of the basket, a magnet placed on the basket, a diaphragm arranged on the basket and above the magnet, and a voice coil. The conduction wire board defines a core hole corresponding to the center hole, and two welding foils on the bottom surface. The magnet defines a through hole corresponding to the center hole. The voice coil is wrapped around the magnet and fixed to the bottom of the diaphragm. The voice coil has leading wires, which bend inward at the top and downward pass through the through hole of the magnet, the center hole of the basket and the core hole of the conduction wire board, and then extend toward two sides of the rivet for being welded on the corresponding welding foils.

2 Claims, 4 Drawing Sheets

LOUDSPEAKER

BACKGROUND OF THE INVENTION

1. Field of the Invention

This present invention relates to a loudspeaker, and more particularly to a loudspeaker which can reduce the noise produced by lead wires.

2. The Related Art

Referring to FIG. 5, a traditional loudspeaker 400 comprises a diaphragm 410, a voice coil 420 for driving the diaphragm 410, a magnet 430 wrapped by the voice coil 420 for producing a magnetic flux in the vicinity of the voice coil 420, and a basket 450. The diaphragm 410, the voice coil 420 and the magnet 430 are arranged in the basket 450. A lead wire 421 of the voice coil 420 is glued on the back of the diaphragm 410, for avoiding the lead wire 421 affecting the diaphragm 410 while the diaphragm 410 is worked.

When the traditional loudspeaker 400 works over a long time, the lead wire 421 will remove from the diaphragm 410 and hit the diaphragm 410, therefore the diaphragm 410 will make noise. This way of the lead wire 421 being glued to the diaphragm 410 increases the associated process of the traditional loudspeaker 400.

SUMMARY OF THE INVENTION

An object of the invention is to provide a loudspeaker comprising a basket, a conduction wire board, a magnet, a diaphragm, a rivet and a voice coil. The basket defines a center hole therethrough. The conduction wire board is fixed to the bottom surface of the basket and defines a core hole corresponding to the center hole of the basket and two welding foils on the bottom surface. The magnet is placed on the basket and defines a through hole corresponding to the center hole of the basket. The diaphragm is arranged on the basket and above the magnet. The rivet defines a middle hole therethrough. The rivet is accepted in the core hole of the conduction wire board, the through hole of the magnet and the center hole of the basket, and puts the conduction wire board, the basket, and the magnet to a unit. The voice coil is wrapped around the magnet and fixed to the bottom of the diaphragm. The voice coil has leading wires, which bend inward at the top and downward pass through the middle hole of the rivet, and then extend toward the two sides for being welded on the corresponding welding foils of the conduction wire board.

As described above, the leading wire of the voice coil bends inward at the top and downward passes through the through hole, the center hole and the core hole, and then extends toward the two sides for being welded on the corresponding welding foils. Therefore, the leading wires do not need to be glued on the diaphragm, then the load of the diaphragm is reduced. Meanwhile, the noise produced by the leading wire hitting the diaphragm when falling off the diaphragm is avoided.

BRIEF DESCRIPTION OF THE DRAWINGS

The invention, together with its objects and the advantages thereof may be best understood by reference to the following description taken in conjunction with the accompanying drawings, in which.

DETAILED DESCRIPTION OF THE PREFERRED EMBODIMENT

Figure 1:
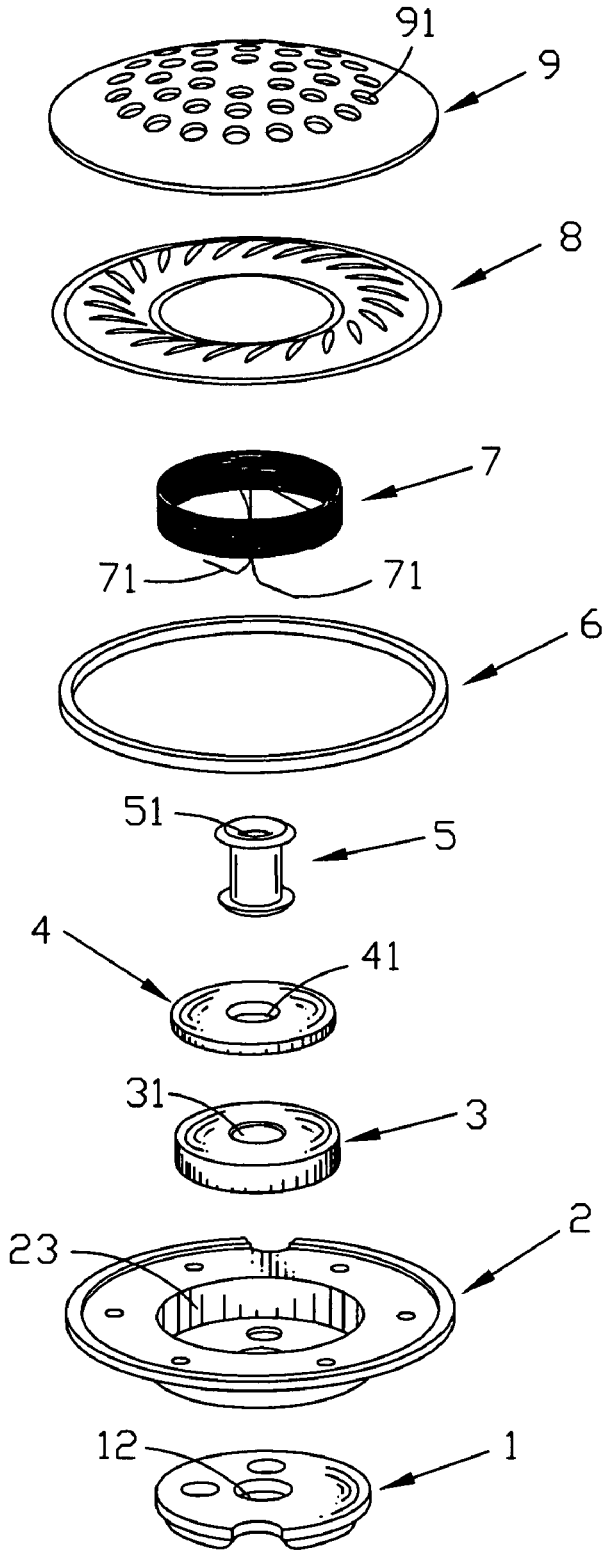
FIG. 1 is an exploded view of a loudspeaker according to the present invention.
Figure 2:
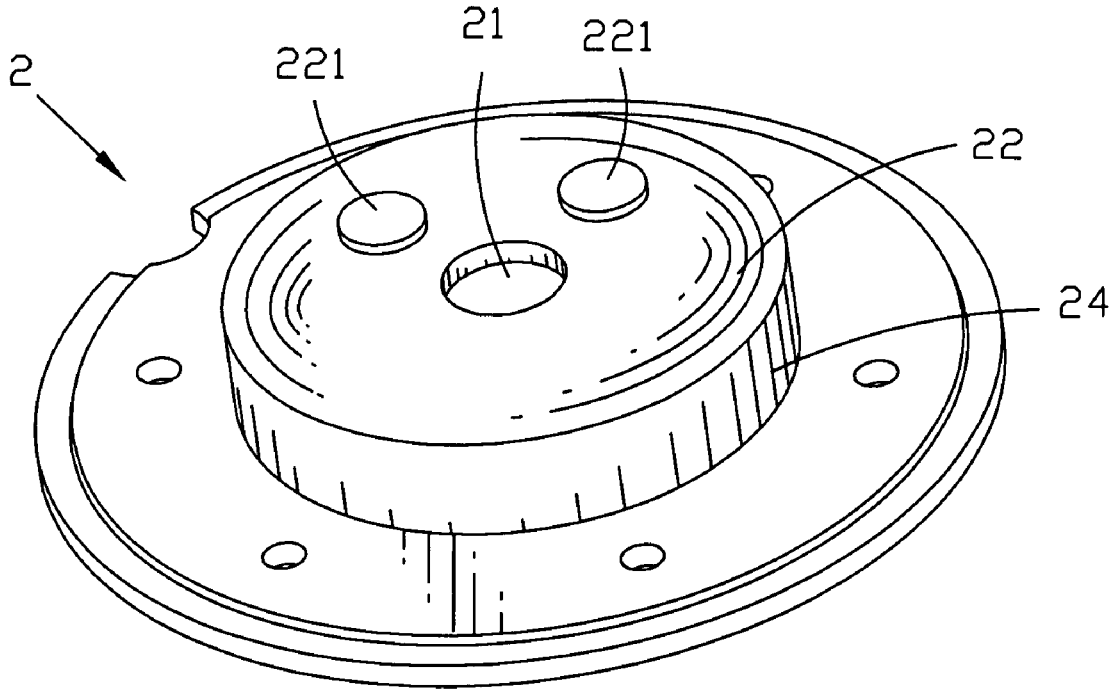
FIG. 2 is a perspective view of a basket of the loudspeaker.

First referring to FIG. 1, a loudspeaker 100 according to the invention is shown. The loudspeaker 100 comprises a conduction wire board 1, a basket 2, a magnet 3, a conduction magnet board 4, a rivet 5, a pad ring 6, a voice coil 7, a diaphragm 8 and a shield 9. The basket 2 has a cylinder shape. In the embodiment, the basket 2 is stampingly formed. As shown in FIG. 2, the center of the basket 2 is stamped downward to form a circular bottom board 22 and an annular side wall 24. The bottom board 22 and the annular side wall 24 define an accepted room 23. A center hole 21 is opened in the center of the bottom board 22. A pair of column lumps 221 are formed on the bottom surface of the bottom board 22 and near to the center hole 21.

Figure 3:
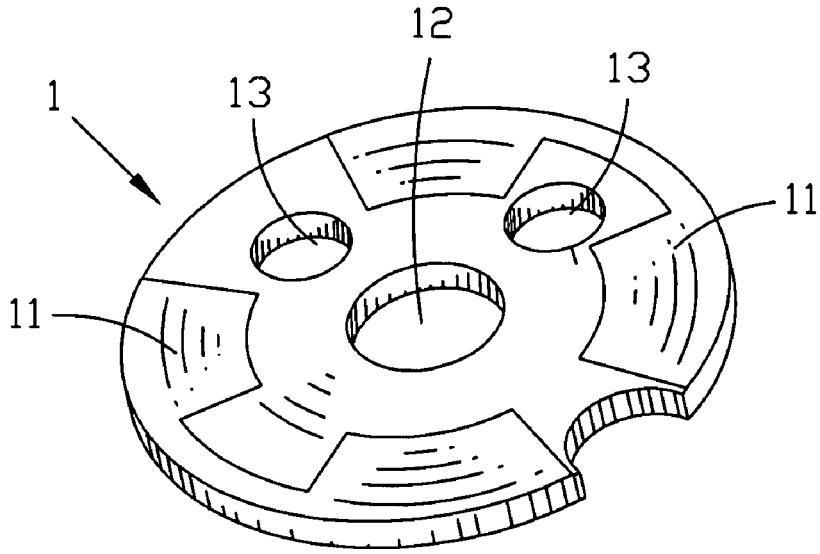
FIG. 3 is a perspective view of a conduction wire board of the loudspeaker.
Figure 4:
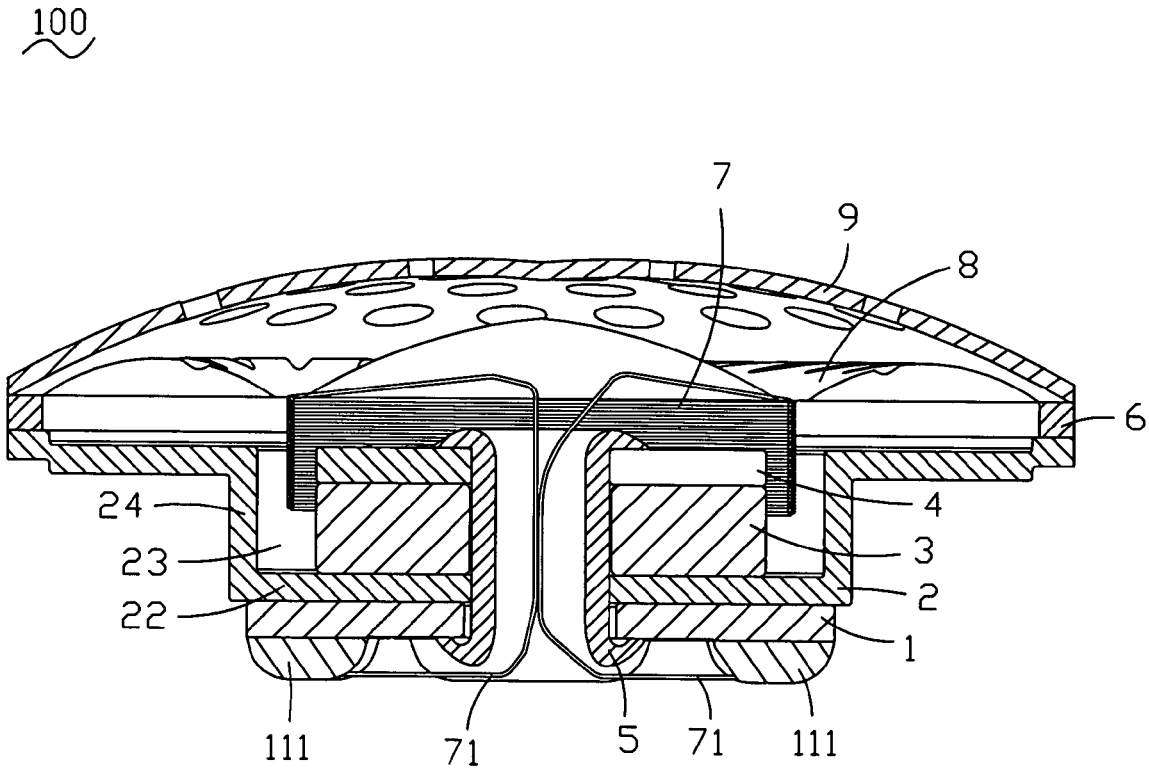
FIG. 4 is a cross-sectional view of the loudspeaker.
Figure 5:
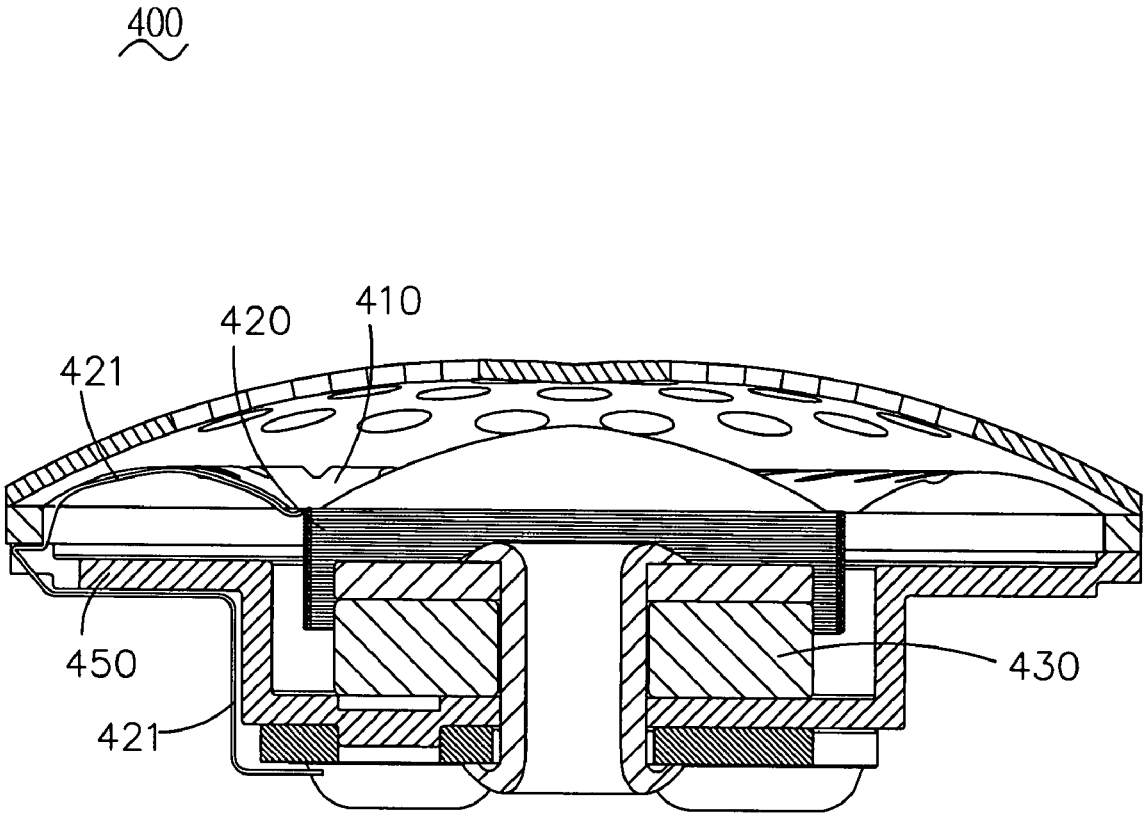
FIG. 5 (Prior Art)
FIG. 5 is a cross-sectional view of a traditional loudspeaker.

Referring to FIG. 3, the conduction wire board 1 is a circular shape and defines a core hole 12 corresponding to the center hole 21 of the basket 2 at the center and two openings 13 beside the core hole 12 therethrough. A pair of welding foils 11 are mounted on the bottom surface of the conduction wire board 1. The openings 13 engage with the column lumps 221, so the conduction wire board 1 and the basket 2 are put together.

The magnet 3 is accepted in the accepted room 23 of the basket 2. The magnet 3 is cylinder-shaped and defines a through hole 31 in the middle. The through hole 31 corresponds to the center hole 21.

The conduction magnet board 4 covers on the magnet 3. The conduction magnet board 4 is cylinder-shaped and defines an aperture 41 therethrough. The aperture 41 is opened in the middle of the conduction magnet board 4 and corresponds to the through hole 31.

The rivet 5 is accepted in the core hole 12 of the conduction wire board 1, the center hole 21 of the basket 2, the through hole 31 of the magnet 3 and the aperture 41 of the conduction magnet board 4. So the rivet 5 puts the conduction wire board 1, the basket 2, the magnet 3 and the conduction magnet board 4 to a unit. The rivet 5 extends upright and defines a middle hole 51 therethrough.

The pad ring 6 is glued on the upper surface of the edge of the basket 2. The diaphragm 8 is glued on the pad ring 6.

A long wire is coiled to form the voice coil 7 which has a cylinder shape. The voice coil 7 has two leading wires 71. The leading wire 71 extends from the top of the voice coil 7, and then bends inward to extend out from the bottom of the voice coil 7. The voice coil 7 is accepted between the annular side wall 24 of the basket 2 and the magnet 3, the top end of the voice coil 7 is glued on the bottom surface of the diaphragm 8. The leading wires 71 of the voice coil 7 downward pass through the middle hole 51 and then extend toward the two sides for being welded on the corresponding welding foils 11 by soldering tins 111.

The shield 9 is glued on the diaphragm 8. The shield 9 has lots of air holes 91. The air holes 91 are used to conduct the voice from the loudspeaker 100 to the outside.

While the audio signal is transmitted to the voice coil 7 by the leading wire 71, the voice coil 7 vibrates up and down under the influence of the magnetic field. The voice coil 7 drives the diaphragm 8, so the diaphragm 8 shakes and makes voice. The voice passes through the air holes 91 to the outside. The length of the leading wire 71 approximately equals the distance from the soldering tin 111 to the top of the voice coil 7 to avoid noise produced by too long leading wire.

As described above, the leading wire 71 of the voice coil 7 bends inward at the top and downward passes through the middle hole 51 of the rivet 5, and then extends toward the two sides for being welded on the corresponding welding foil 11. Therefore, the leading wire 71 do not need to be glued on the diaphragm, then the load of the diaphragm 8 is reduced. Meanwhile, the noise produced by the leading wire 71 hitting the diaphragm 8 when falling off the diaphragm 8 is avoided.

An embodiment of the present invention has been discussed in detail. However, this embodiment is merely a specific example for clarifying the technical contents of the present invention and the present invention is not to be construed in a restricted sense as limited to this specific example. Thus, the spirit and scope of the present invention are limited only by the appended claims.

What is claimed is:

1. A loudspeaker, comprising:

a basket defining a center hole therethrough;

a conduction wire board fixed to the bottom surface of the basket and defining a core hole corresponding to the center hole of the basket and welding foils on the bottom surface;

a magnet placing on the basket, the magnet defining a through hole corresponding to the center hole of the basket;

a rivet defining a middle hole therethrough, the rivet being accepted in the core hole of the conduction wire board, the through hole of the magnet and the center hole of the basket, and putting the conduction wire board, the basket, and the magnet to a unit;

a diaphragm arranged on the basket and above the magnet; and a voice coil wrapped around the magnet and fixed to the bottom of the diaphragm, the voice coil having leading wires bending inward at the top and downward passing through the middle hole of the rivet, and then extending toward two sides of the rivet for being welded on the corresponding welding foils.

2. The loudspeaker as set forth in claim 1, further comprising a conduction magnet board having an aperture, the conduction magnet board being arranged above the magnet, the aperture corresponding to the through hole of the magnet, the rivet passing through the aperture of the conduction magnet board, and putting the conduction magnet board and said unit together.

* * * * *